US006085449A

United States Patent [19]

Tsui

[11] Patent Number: 6,085,449

[45] Date of Patent: Jul. 11, 2000

[54] ARMBAND BADGE HOLDER

[75] Inventor: Ping Tsui, Lexington, Mass.

[73] Assignee: Comprehensive Identification Products, Inc., Burlington, Mass.

[21] Appl. No.: 09/007,688

[22] Filed: Jan. 15, 1998

[51] Int. Cl.[7] ..... A44C 3/00; A44C 5/00; G09F 3/14; A45C 13/30; A45F 5/00

[52] U.S. Cl. ..... 40/1.6; 40/665; 40/633; 224/222; 224/267; 2/67

[58] Field of Search ..... 40/1.5, 1.6, 633, 40/665; 63/3.1, 3.2; 224/222, 267, 219; 24/265, 196, 197, 302; 2/170, 309, 311, 312, 317, 321, 322; 450/86

[56] References Cited

U.S. PATENT DOCUMENTS

| | | | |
|---|---|---|---|
| D. 259,973 | 7/1981 | Walasek | D3/34 |
| D. 265,861 | 8/1982 | Walasek | D2/402 |
| D. 299,585 | 1/1989 | Corwin et al. | D2/630 |
| D. 318,570 | 7/1991 | Walasek | D3/106 |
| D. 320,307 | 10/1991 | Walasek | D3/56 |
| D. 332,005 | 12/1992 | Walasek | D3/35 |
| D. 341,488 | 11/1993 | Walasek | D3/100 |
| 987,262 | 3/1911 | Schwartz | 24/302 |
| 1,080,240 | 12/1913 | Tidd . | |
| 1,258,077 | 3/1918 | Worcester . | |
| 1,427,891 | 9/1922 | Ziegler | 40/633 |
| 1,434,775 | 11/1922 | Fenno . | |
| 2,057,575 | 10/1936 | Houghton | 24/197 |
| 2,203,155 | 6/1940 | Jullien | 224/222 |
| 2,392,533 | 1/1946 | Isaac . | |
| 2,599,311 | 6/1952 | Anderson | 40/654 |
| 2,808,973 | 10/1957 | Gobble . | |
| 3,121,270 | 2/1964 | Van Den Broek et al. | 24/197 |
| 3,215,144 | 11/1965 | Schustack | 2/325 |
| 3,232,685 | 2/1966 | Wilstein et al. | 224/267 |
| 3,502,396 | 3/1970 | Greenberg | 24/302 |
| 3,586,220 | 6/1971 | Reinsberg | 224/28 |
| 4,332,338 | 6/1982 | Christiansen | 224/222 |
| 4,415,106 | 11/1983 | Connell et al. | 224/221 |
| 4,509,667 | 4/1985 | Meldrum | 224/222 |
| 4,670,945 | 6/1987 | Banks | 24/197 |
| 4,957,310 | 9/1990 | Bissonnette | 283/34 |
| 5,165,113 | 11/1992 | Hyams et al. | 2/268 |
| 5,213,241 | 5/1993 | Dewar et al. | 224/222 |
| 5,318,084 | 6/1994 | Jackson | 150/109 |
| 5,347,656 | 9/1994 | Fabritz et al. | 2/67 |
| 5,386,933 | 2/1995 | Greene et al. | 224/219 |
| 5,400,936 | 3/1995 | Jones et al. | 224/222 |
| 5,406,726 | 4/1995 | Fan | 40/1.6 |
| 5,410,828 | 5/1995 | Millet et al. | 40/665 |
| 5,733,004 | 3/1998 | Celestina-Krevh et al. | 24/197 |

FOREIGN PATENT DOCUMENTS

| | | | |
|---|---|---|---|
| 546640 | 11/1922 | France | 40/665 |
| 1515632 | 1/1968 | France | 40/633 |
| 29444 | of 1914 | United Kingdom | 40/665 |

*Primary Examiner*—Anthony Knight
*Assistant Examiner*—Vishal Patel
*Attorney, Agent, or Firm*—Hamilton, Brook, Smith & Reynolds

[57] ABSTRACT

A badge holder securable to a limb includes a badge holder pocket having first and second retaining wings extending from opposite sides of the pocket. The retaining wings have a passage extending through the wings. A strap assembly having a strap member with first and second ends is included. A first hook fitting is secured to the first end of the strap and a second hook fitting is secured to the second end of the strap. The first and second hook fittings are removably securable to the respective first and second wings by engaging the passages of the wings for coupling the strap assembly to the badge holder pocket.

24 Claims, 3 Drawing Sheets

ARMBAND BADGE HOLDER

BACKGROUND OF THE INVENTION

Identification badges are often worn by service or security personnel. During the winter, when wearing heavy jackets, the identification badges are commonly worn on the arm within an armband badge holder. Armband badge holders are typically formed from two flexible transparent or combination of transparent, semi-opaque or opaque plastic sheets which are heat sealed together to form a flat pocket. An opening in the rear of the pocket allows the identification badge to be inserted into the pocket. The flexible plastic pocket protects the identification badge while at the same time allowing it to be seen. An elastic strap is typically secured to the flat pocket through slots in opposing edges of the flat pocket. The ends of the elastic strap pass through respective slots and form loops to secure the pocket to the strap. The loops are closed either by sewing them closed or fastening them to a buckle. The elastic strap allows the armband badge holder to be worn on the arm of a user and can be adjustable to fit different arm sizes. The flexible nature of the flat pocket allows it to curve, thereby conforming generally to the arm of the user.

SUMMARY OF THE INVENTION

If the loops of the elastic strap are sewn, the arm badge holder is sold with the elastic strap already attached. In addition, if the loops of the elastic strap are formed with buckles, the arm badge holder is preferably sold with the elastic strap already attached because assembly is sometimes too complicated or confusing for some users.

The present invention provides a badge holder having an easily attachable strap assembly which allows the badge holder to be stored and sold unassembled, thereby reducing manufacturing and inventory costs. The present invention badge holder is securable to a limb and includes a badge holder pocket having first and second retaining wings extending from opposite sides of the pocket. The retaining wings each have a passage extending therethrough. A strap assembly having a strap member with first and second ends is included. A first hook is secured to the first end of the strap and a second hook is secured to the second end of the strap. The first and second hooks are removably securable to the respective first and second wings by engaging the passages of the wings for removably coupling the strap assembly to the badge holder pocket.

In preferred embodiments, the badge holder pocket is formed from two sheets of flexible transparent plastic material which are sealed together. The retaining wings are formed by securing flexible material to opposite sides of the pocket. The flexible material is folded to form the passages. Access to the pocket is provided by a slit in one of the sheets of plastic material. The badge holder pocket includes a heat sealed line between the slit and each wing for strength and flexibility.

Each hook fitting preferably has a ring portion fixedly secured to the strap member and a hook member separated from the ring portion by an open ended slot. The open ended slot has a closed end and an opposed notch for removably capturing a retaining wing therebetween. Each open ended slot has an entry way with a width that is about equal or less than the material thickness of the retaining wings so that the material of the retaining wings compresses when entering or exiting the entry way. The notch is formed by a protrusion extending from the hook member near the entry way. The narrow entry way and the opposed notch prevent the hook members from unintentionally disengaging from the retaining wings. Preferably, the hook member at the first end of the strap faces in an opposite direction to the hook member at the second end of the strap for further preventing unintentional disengagement. The strap is preferably formed of elastic material and is adjustable.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
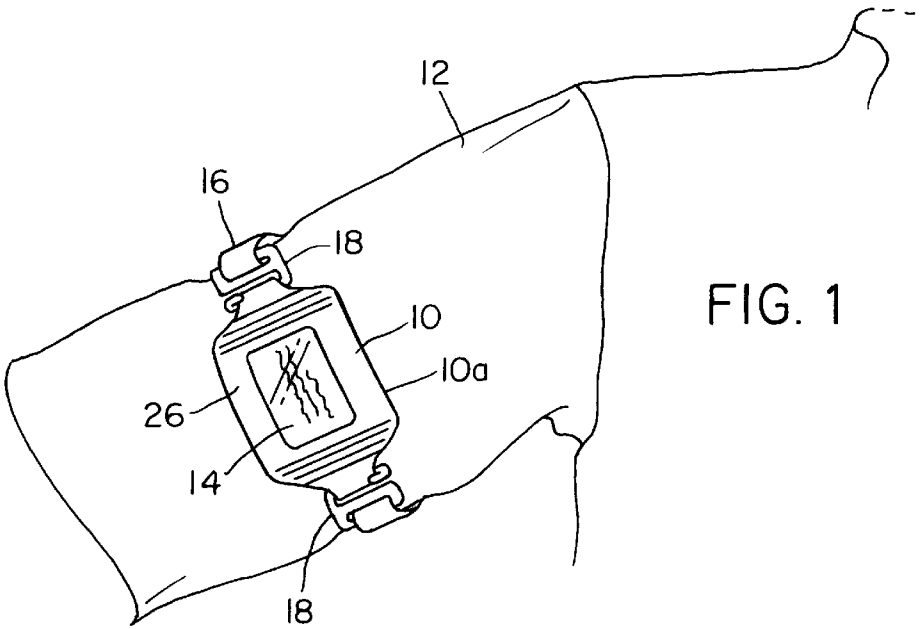
FIG. 1 depicts the present invention armband badge holder secured to the arm of a user.

Referring to FIG. 1, the present invention armband badge holder 10 includes a transparent badge holder sleeve 10*a* and a strap assembly 16 which is secured to the badge holder sleeve 10*a* with two hook fittings 18. The badge holder sleeve 10*a* includes a flat pocket 26 for containing an identification badge 14. The strap assembly 16 allows the badge holder sleeve 10*a* to be secured to the arm 12 of a user. The transparent nature of the badge holder sleeve 10*a* allows the identification badge 14 to be visible while at the same time protecting the identification badge 14 from wear and foul weather when worn outside.

Figure 4:
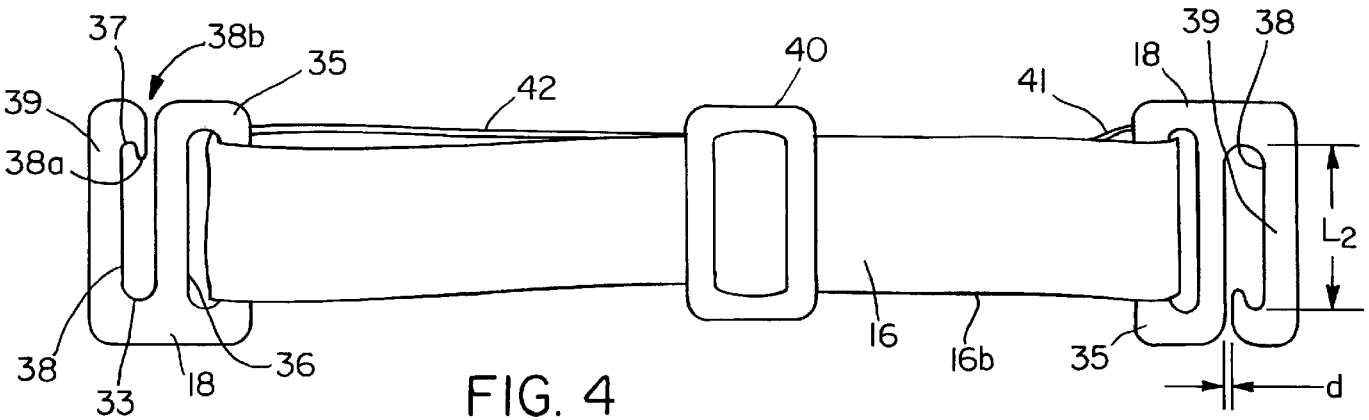
FIG. 4 is a front view of the strap.
Figure 2:
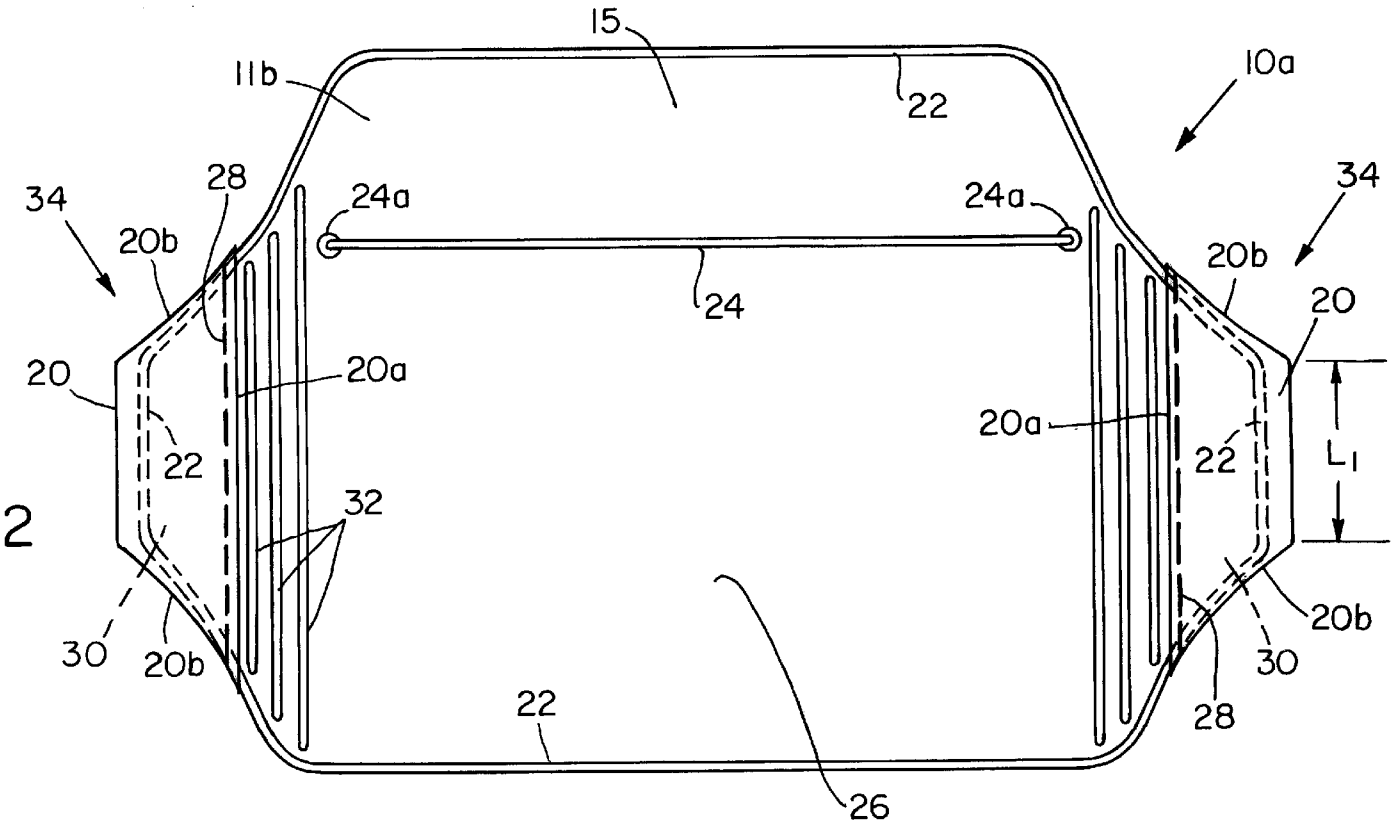
FIG. 2 is a rear view of the badge holder sleeve.
Figure 3:
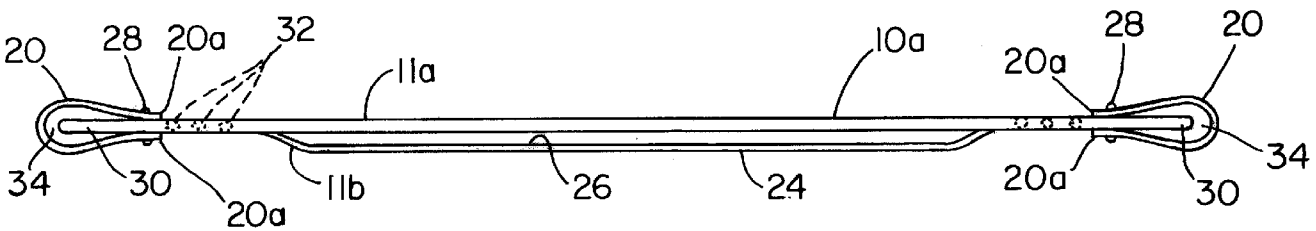
FIG. 3 is a top edge view of the badge holder sleeve.

Referring to FIGS. 2, 3 and 4, badge holder sleeve 10*a* is formed from two sheets 11*a* and 11*b* of flexible transparent plastic which are heat sealed together along the perimeter as shown by seal line 22. Badge holder sleeve 10*a* has a generally rectangular central portion 15 and two generally trapezoidal end portions 30 located on opposite sides of central portion 15. The central portion 15 of badge holder sleeve 10*a* is separated from the end portions 30 by three heat sealed lines 32 extending from top to bottom. The heat sealed lines 32 provide strength to badge holder sleeve 10*a* by bonding sheets 11*a*/11*b* together and increases flexibility at those regions by forming fold lines. It has been found that three heat sealed lines 32 made adjacent to each other greatly increases the ability for badge holder sleeve 10*a* to bend at those regions thereby enabling badge holder sleeve 10*a* to easily conform to the shape of a user's arm 12. The heat sealed lines 32 have a radius of curvature that is less than regions of badge holder sleeve 10*a* away from sealed lines 32. Heat sealed lines 32 also provide strain relief and reinforcement at points of tension and prevents sheets 11*a*/11*b* from pulling apart. Central portion 15 includes a slit 24 through the rear sheet 11*b* which provides access to a flat pocket 26 formed between sheets 11*a* and 11*b*. Slit 24 is heat sealed at its ends 24*a* to prevent tearing. Identification badge 14 is inserted through slit 24 into flat pocket 26 and is visible through the front sheet 11*a*. Since slit 24 is formed in the rear sheet 11*b*, when armband badge holder 10 is worn, slit 24 lies against the arm 12 of the user such that identification badge 14 is protected against wet weather conditions. Although badge holder sleeve 10*a* is preferably formed by heat sealing two sheets of transparent plastic together, alternatively, badge holder sleeve 10*a* can be formed from any combination of transparent, semi-opaque and opaque materials. In addition, instead of heat sealing, badge holder sleeve 10*a* can be sealed by electronic welding, sewing, ultrasonic welding or gluing, etc. Furthermore, badge holder sleeve 10*a* can have more than three or less than three heat sealed lines 32.

Two generally trapezoidal retaining wings 20 are secured to end portions 30 adjacent to heat sealed lines 32. Each retaining wing 20 is formed from a flexible generally non-stretchable material that is folded in half to form an elongated flattened tube-like passage 34 extending through the retaining wing 20 between angled edges 20*b*. Each passage 34 lies substantially along the same plane as badge holder sleeve 10*a* when in a flattened state. The openings to passages 34 face in the same direction as the top and bottom edges of badge holder sleeve 10*a*. The edges 20*a* of each retaining wing 20 are sewn to opposite sides of an end portion 30 with stitching 28. Retaining wings 20 are preferably made of a material that is stiff enough to retain its own shape when secured to end portions 30, such as fiber filament reinforced vinyl artificial leather. Although retaining wings 20 are preferably sewn to end portions 30, alternatively, retaining wings 20 can be glued to end portions 30. In addition, if the material of retaining wings 20 is compatible with end portions 30, the retaining wings can be heat or ultrasonically welded to end portions 30. End portions 30 preferably extend a substantial distance within the passages 34 of retaining wings 20, but alternatively, end portions 30 can be shorter and terminate near stitching 28. Furthermore, retaining wings 20 can be formed of stretchable material. In such a case, strap assembly 16 can have a nonstretchable strap.

In one preferred embodiment, retaining wings 20 are about 2.2 inches high and about 0.85 inches wide with a minimum passage 34 length $L_1$ of about 0.82 inches. The artificial leather material forming retaining wings is about 0.032 inches thick. The sheets 11*a*/11*b* of flexible plastic is preferably vinyl and is about 0.03 inches thick. The length of badge holder sleeve 10*a* from the outer edges of retaining wings 20 is about 6.5 inches with the size of central portion 15 being about 4×4 inches. The dimensions of badge holder sleeve 10*a* can be varied to accommodate different sized users and different sized identification badges.

Strap assembly 16 includes an elastic strap 16*b* which is secured to hook fittings 18. One hook fitting 18 is secured to strap 16*b* by a small loop 41 of strap 16*b* and the other hook fitting 18 is secured to strap 16*b* by an adjustable loop 42. Loop 42 of strap 16*b* is secured to a sliding buckle 40 which slides for adjusting the length of strap 16*b*. Strap assembly 16 in one preferred embodiment is adjustable between about 11 inches and 6.5 inches long. The width of strap 16*b* is preferably about 1 inch. These dimensions can be varied depending upon the size of the user and the size of badge holder sleeve 10*a*. Although strap 16*b* is preferably adjustable and formed of elastic material, alternatively, strap 16*b* can be elastic but nonadjustable or formed of nonstretchable material and adjustable.

Each hook fitting 18 includes a generally rectangular ring portion 35 with a slotted hole 36 for securing to loops 41 and 42 of strap 16*b*. A hook member 39 extends from ring portion 35 for engaging the passage 34 of retaining wings 20 to secure strap assembly 16 to badge holder sleeve 10*a*. Hook member 39 is preferably substantially linear or straight. An open ended slot 38 separates hook member 39 from ring portion 35. Hook member 39 includes a protrusion 38*a* which extends into slot 38 to form a notch 37 in slot 38 opposite to closed end 33. The protrusion 38 forms a "J" hook at the end of hook member 39. Access to slot 38 is provided through a narrow opening 38*b* between ring portion 35 and hook member 39 along the edge of protrusion 38*a*. Opening 38*b* is offset from notch 37 and is separated from notch 37 by protrusion 38*a*. The distance d of the opening 38*b* is about equal to or slightly less than the thickness of the material forming retaining wings 20. As a result, the material of a retaining wing 20 compresses when entering or exiting. The exterior entrance to opening 38*b* is curved for easy entrance.

Once engaged, retaining wings 20 are captured within slots 38 between notches 37 and closed ends 33. The length $L_2$ between each notch 37 and closed end 33 is approximately equal to the length $L_1$ of each passage 34 at the outer edge of a retaining wing 20 so that the angled edges 20*b* rest against a notch 37 and a closed end 33. Protrusions 38*a* prevent retaining wings 20 from exiting slots 38 through openings 38*b*. In addition, the small dimension of distance d of openings 38*b* also makes it difficult for retaining wings 20 to exit through openings 38*b*. The combination of the notch 37, protrusion 38*a* and opening 38*b* of each hook fitting 18 provides a tortuous path for a retaining wing 20 to exit hook fitting 18 for preventing unintentional disengagement. Hook members 39 preferably face in opposite directions to make unintentional disengagement of hook members 39 from retaining wings 20 even less likely to happen. Alternatively, hook members 39 can face in the same direction. Hook fittings 18 allow strap assembly 16 to be easily securable to and removable from badge holder sleeve 10*a*. As a result, the strap assembly 16 can be easily exchanged for one of a different length or color if desired to suit a particular user's needs and tastes. This allows the badge holder sleeve 10*a* and strap assembly 16 to be stored and sold unassembled, thereby reducing manufacturing and inventory costs.

In one preferred embodiment, hook fittings 18 are stamped in one piece from sheet metal about 0.042 inches thick. The outside dimensions of such hook fittings 18 are about 1.3 inches high and about 0.8 inches wide with about ⅛ inch radii at the corners. Hook member 39 is about 0.18 inches wide and widens at the portion including protrusion 38*a* to about 0.3 inches. The length $L_2$ of slot 38 between notch 37 and closed end 33 is preferably about 0.86 inches long and the width of slot 38 is about 0.18 inches. Notch 37 is about 0.07 inches wide and 0.07 inches deep. The distance d of opening 38*b* at the narrow portion is preferably about 0.032 inches with opening 38*b* being about 0.3 inches long. The narrow portion of opening 38*b* is straight and about 0.2 inches long. These dimensions may vary due to manufacturing tolerances or to accommodate different sized retaining wings 20.

Figure 5:
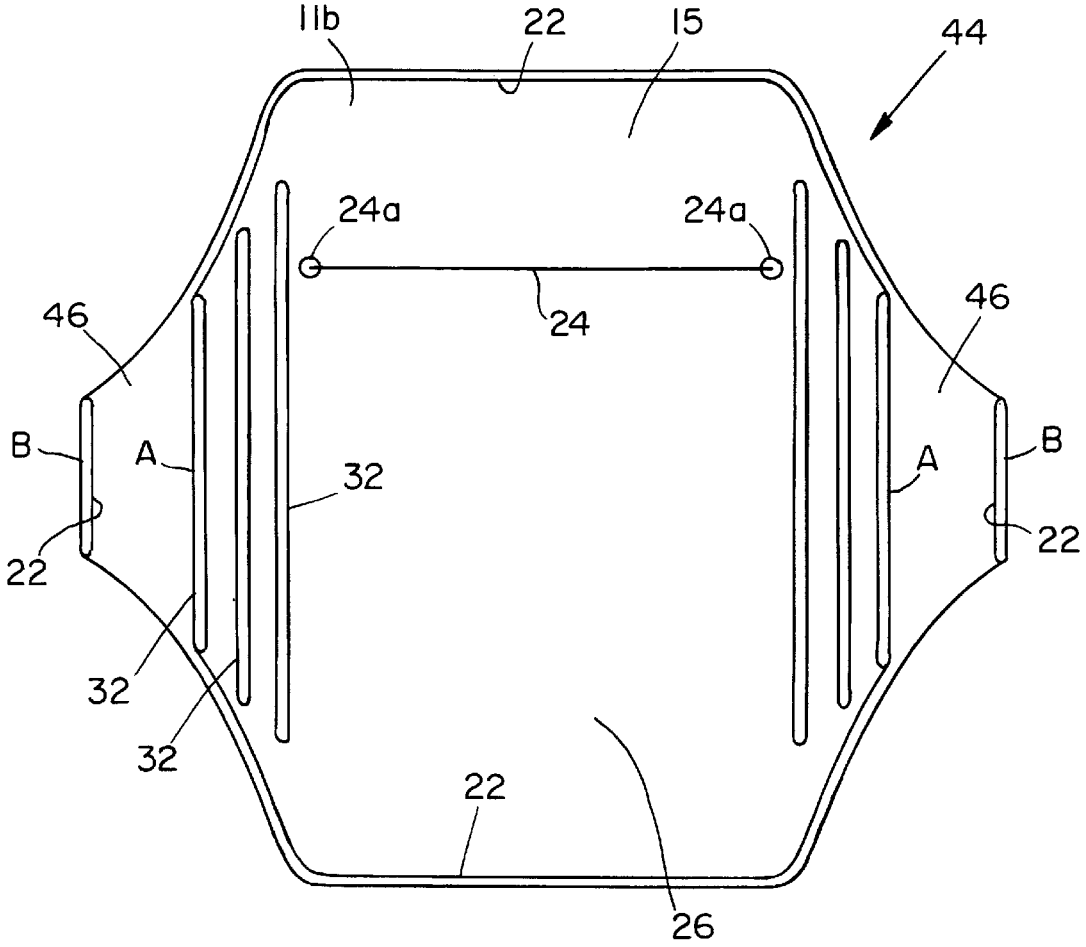
FIG. 5 is a rear view of another preferred badge holder sleeve.
Figure 6:
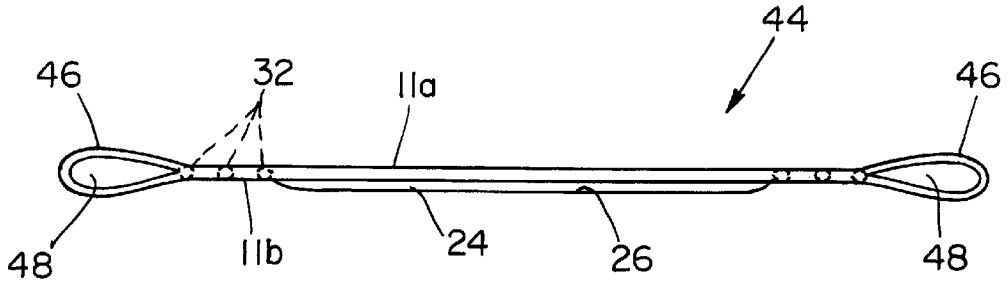
FIG. 6 is a top edge view of the badge holder sleeve of FIG. 5.

Referring to FIGS. 5 and 6, badge holder sleeve 44 is another preferred badge holder sleeve which differs from badge holder sleeve 10*a* in that end portions 46 are formed by heat sealing sheets 11*a* and 11*b* at locations A and B to form retaining wings 48 instead of securing separate pieces of material to the pocket to form the retaining wings.

Equivalents

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

The present invention has been described to be an armband badge holder but can be secured to any limb. In addition, the present invention is useful for containing personnel identification badges as well as company and organizational badges.

What is claimed is:

1. A badge holder assembly securable to a limb comprising:

a badge holder pocket having first and second retaining wings extending from opposite sides of the pocket, each retaining wing having a tube-like passage extending within the retaining wing, openings to the tube-like passage extending through opposed perimeter edges of the retaining wing; and a strap assembly having a strap member with first and second ends, a first hook fitting being secured to the first end of the strap and a second hook fitting being secured to the second end of the strap, each hook fitting having a ring portion fixedly secured to the strap member and a hook member separated from the ring portion by an open ended slot, the open ended slot having a closed end and an opposed notch, the first and second hook fittings capable of being removably secured to the respective first and second wings by engaging the passages of the wings with the hook members and removably capturing the wings between the closed end and the opposed notch of the open ended slots for removably coupling the strap assembly to the badge holder pocket, each open ended slot having an entry way, the entry way including a straight elongate portion that is sized to compress material of the retaining wings during entry and exit.

2. The badge holder assembly of claim 1 in which the badge holder pocket is formed from two sheets of flexible transparent plastic material which are sealed together.

3. The badge holder assembly of claim 2 in which the retaining wings are formed by securing flexible material to the opposite sides of the pocket, the flexible material being folded to form the passages.

4. The badge holder assembly of claim 6 in which the flexible material of the retaining wings has a material thickness, each open ended slot having an entry way with a width that is about equal or less than the material thickness of the retaining wings.

5. The badge holder assembly of claim 4 in which the notch is formed by a protrusion extending from the hook member near the entry way.

6. The badge holder assembly of claim 5 in which the hook member at the first end of the strap faces in an opposite direction to the hook member at the second end of the strap.

7. The badge holder assembly of claim 2 in which access to the pocket is provided by a slit in one of the sheets of plastic material.

8. The badge holder assembly of claim 7 in which the badge holder pocket includes a heat sealed line between the slit and each wing for strength and flexibility.

9. The badge holder assembly of claim 1 in which the strap is made of elastic material.

10. The badge holder assembly of claim 9 in which the strap assembly is adjustable.

11. A badge holder assembly securable to a limb comprising:

a badge holder pocket formed from two sheets of flexible transparent plastic which are sealed together, the badge holder pocket having first and second retaining wings extending from opposite sides of the pocket, each retaining wing having a tube-like passage extending within the retaining wing, openings to the tube-like passage extending through opposed angled perimeter edges of the retaining wing that angle towards each other; and a strap assembly having a strap member with first and second ends, a first hook fitting being secured to the first end of the strap and a second hook fitting being secured to the second end of the strap, each hook fitting having a ring portion for securing to the strap member and a hook member separated from the ring portion by an open ended slot, the open ended slot having a closed end and an opposed notch, the first and second hook fittings capable of being removably secured to the respective first and second wings for removably coupling the strap assembly to the badge holder pocket by engaging the passages of the wings with the hook members and removably capturing the retaining wings between the closed end and the opposed notch of the open ended slots, each open ended slot having an entry way, the entry way including a straight elongate portion that is sized to compress material of the retaining wings during entry and exit.

12. The badge holder assembly of claim 11 in which the retaining wings are formed by securing flexible material to the opposite sides of the pocket, the flexible material being folded in half to form the passages.

13. The badge holder assembly of claim 12 in which access to the pocket is provided by a slit in one of the sheets of plastic material.

14. The badge holder assembly of claim 13 in which the badge holder pocket includes a heat sealed line between the slit and each wing for strength and flexibility.

15. The badge holder assembly of claim 14 in which the flexible material of the retaining wings has a material thickness, each open ended slot having an entry way with a width that is about equal or less than the material thickness of the retaining wings.

16. The badge holder assembly of claim 15 in which the notch is formed by a protrusion extending from the hook member near the entry way.

17. The badge holder assembly of claim 4 in which the hook member at the first end of the strap faces in an opposite direction to the hook member at the second end of the strap.

18. A method of forming a badge holder comprising the steps of:

providing a badge holder pocket having first and second retaining wings extending from opposite sides of the pocket, each retaining wing having a tube-like passage extending within the retaining wing, openings to the tube-like passage extending through opposed perimeter edges of the retaining wing;

providing a strap assembly having a strap member with first and second ends, a first hook fitting being secured to the first end of the strap and a second hook fitting being secured to the second end of the strap, each hook fitting having a ring portion fixedly secured to the strap member and a hook member separated from the ring portion by an open ended slot, the open ended slot having a closed end and an opposed notch, the first and second hook fittings being removably securable to the respective first and second retaining wings with the hook members and removably capturing the wings between the closed end and the opposed notch of the open ended slots for removably coupling the strap assembly to the badge holder pocket by engaging the passages of the wings, each open ended slot having an entry way, the entry way including a straight elongate portion that is sized to compress material of the retaining wings during entry and exit.

19. The method of claim 18 further comprising the step of forming the badge holder pocket by heat sealing two sheets of flexible transparent plastic material together.

20. The method of claim 19 further comprising the step of forming the retaining wings by folding flexible material in half and securing the flexible material to opposite sides of the pocket.

21. The method of claim 20 further comprising the step of forming a slit in one of the sheets of plastic material for providing access to the pocket.

22. The method of claim 21 further comprising the step of forming a heat sealed line between the slit and each wing for strength and flexibility.

23. The method of claim 20 in which the material of the retaining wings has a thickness, the method further comprising the step of forming an entry way to the open ended slot with a width that is about equal or less than the material thickness of the retaining wings.

24. The method of claim 18 further comprising the step of positioning the hook member at the first end of the strap in an opposite direction to the hook member at the second end of the strap.

* * * * *

UNITED STATES PATENT AND TRADEMARK OFFICE

CERTIFICATE OF CORRECTION

PATENT NO. : 6,085,449
DATED : July 11, 2000
INVENTOR(S) : Ping Tsui

It is certified that error appears in the above-identified patent and that said Letters Patent is hereby corrected as shown below:

Claim 4, column 5, line 47, delete "6" and insert ---1---;
Claim 17, column 6, line 48, delete "4" and insert ---6---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*